United States Patent [19]

Reitz

[11] Patent Number: 4,759,000

[45] Date of Patent: Jul. 19, 1988

[54] ACOUSTIC ENERGY ABSORBING MATERIAL

[76] Inventor: Ronald P. Reitz, P.O. Box 1543, Annapolis, Md. 21404

[21] Appl. No.: 919,651

[22] Filed: Oct. 16, 1986

Related U.S. Application Data

[63] Continuation-in-part of Ser. No. 744,477, Jun. 13, 1985, abandoned.

[51] Int. Cl.[4] ..... H04R 17/00

[52] U.S. Cl. ..... 367/176; 181/286; 181/288; 181/290; 367/1; 367/171

[58] Field of Search ..... 181/151, 198, 210, 211, 181/258, 264, 286, 288, 279, 292, 290; 367/162, 166, 171, 173

[56] References Cited

U.S. PATENT DOCUMENTS

| | | | |
|---|---|---|---|
| 2,415,832 | 2/1947 | Mason | 367/162 X |
| 3,858,165 | 12/1974 | Pegg | 181/0.5 |
| 4,126,149 | 11/1978 | Reitz | 136/89 |
| 4,179,627 | 12/1979 | Reitz | 136/89 |
| 4,353,768 | 10/1982 | Goodman | 181/286 |
| 4,399,526 | 8/1983 | Eynck | 367/149 |
| 4,439,497 | 3/1984 | DiFoggio | 181/207 |
| 4,450,544 | 5/1984 | Denaro et al. | 367/176 |
| 4,528,652 | 7/1985 | Horner et al. | 367/140 |

FOREIGN PATENT DOCUMENTS 2063007A 5/1981 United Kingdom .

*Primary Examiner*—Deborah L. Kyle
*Assistant Examiner*—Brian Steinberger
*Attorney, Agent, or Firm*—Foley & Lardner, Schwartz, Jeffery, Schwaab, Mack, Blumenthal & Evans

[57] ABSTRACT

An acoustic energy absorbing baffle comprising a fluid containment means having an acoustic window means, a viscous fluid contained within said fluid containment, a porous material comprising strands of wire and being immersed within said viscous fluid means, a compliant mass means and means for holding said compliant mass means in close proximity of said porous material means such that the motion of said compliant mass means is imparted to said porous material. Incident acoustical energy is transmitted through the acoustic window and translated into energy absorbing motion of the porous material by acoustical excitation of the compliant mass means.

36 Claims, 3 Drawing Sheets

TEMP. 30°c
PRESSURE 25 ps

ACOUSTIC ENERGY ABSORBING MATERIAL

This is a continuation-in-part of U.S. patent application Ser. No. 744,477, filed June 13, 1985, now abandoned.

BACKGROUND

1. Field of the Invention

This invention relates generally to sonar equipment and in particular to an acoustical energy absorbing baffle.

2. Description of Prior Art

Just after World War II, Mason disclosed that sound could be absorbed by the use of slotted plates or screens. As taught in U.S. Pat. No. 2,415,832 he used an oil and immersed his slotted plates therein. He provided for a backing resonator for this configuration of baffle which absorbs underwater sound. The physical mechanism that he used is that of absorbing acoustic energy by the frictional losses created by the motion of the oil through the slots in plates. In order for the acoustic resistance to be appropriate for the loss to be achieved, it is necessary to control the size of the holes or slots in the plates to a high degree of precision. For the loss to be appreciable, the plate or screen must be kept relatively rigid. Goodman recognized the importance of this and, as taught in U.S. Pat. No. 4,353,768, developed a method for constructing lightweight resistive screens. Denaro et al. in U.S. Pat. No. 4,450,544 also employed the resistive screen technology to absorb underwater sound. The screens have a plurality of restricted orifaces in them and the absorbing mechanism is still due to the frictional losses generated by the oil moving through the orifaces in the screens. This mechanism is not the physical mechanism that is used by the present invention. The present invention absorbs acoustic energy in a manner that differs significantly from the resistive screen/oil frictional losses as taught by Denaro. The disadvantage of using the resistive screen/oil frictional loss mechanism is that the screen must be kept rigid. At low frequencies, say, below 800 Hz, the screens cannot be kept rigid in most sonar systems. This is because the screens are kept rigid as a result of mass loading. The mass of most ships is sufficient to mass load the resistive screens adequately for frequencies above 1000 Hz. But at low frequencies, below 800 Hz, most ships are not massive enough to sufficiently keep the screen rigid. Hence the absorption of sound is limited to above 800 Hz for a baffle that uses the resistive screen/oil frictional loss mechanism. Before discussing the present invention, however, other prior art should first be discussed.

Acoustic window materials are discussed in U.S. Pat. No. 3,858,165. The teachings found therein are not necessarily pertinent to the function of the present invention. While it is true that that an acoustic window of the kind disclosed in U.S. Pat. No. 3,858,165 can be used in the present invention, it should be noted that for frequencies below 15 kHz, a 1/16th inch thick piece of steel or other metal may work just as well. Use of the acoustic window as disclosed in U.S. Pat. No. 3,858,165 may be worthwhile, however, if among the frequencies of sound that is intended for absorption by the present invention there are higher than 20 kHz sound waves.

As taught in U.S. Pat. No. 4,399,526 elastomeric materials may be used to absorb underwater sound. The principle disadvantages with these kinds of absorbers are that their performance changes appreciably with even small changes in their temperature. This is because these materials have physical properties such as their bulk modulus, shear modulus and corresponding loss factors that change as the temperature of the material changes from, say, 33° F. to 55° F. or from 55° F. to 75° F. The acoustic loss is usually dependent therefore, on the temperature of the environment in which the elastomer is placed. This severely restricts the use of this baffle. Some transducers are also limited in their effectiveness for the same reason.

Consider for example, the transducer discussed in UK Pat. No. 2,063,007. The transducer here has a transducer element backed by an elastomer such as neoprene or urethane. Both the neoprenes and the urethanes have shear moduli and corresponding loss factors that change appreciably with small changes in temperature. For this reason, the transducer effectiveness will vary, depending upon the temperature of the water in which it is placed.

A similar difficulty is found with the attenuating material found in U.S. Pat. No. 4,528,652. In this patent, the attenuating material comprises a low viscousity gel with a filler of heavy oxides or metal powder. A gel of silicone epoxy or rubber is the preferred material in this patent. Again, the attenuating material uses the hysteresis loss that occurs in the epoxy or rubber. Such a hysteresis loss is quite temperature dependent, at least for the range of ocean temperatures for the earth (0° C.–25° C.).

The present invention uses strands of wire immersed in oil and a complaint mass, all of which is housed in a rigid housing. Sound causes the complaint mass to resonate and the resonating motion of the compliant mass causes motion in the wire strands that are proximate to it. The motion of the wire strands through the oil causes some acoustic loss. The wire strands also rub against each other. This rubbing action causes a frictional loss. The oil is selected so that the oil used in the present invention has a viscousity and a frictional coefficient that does not change appreciably over the changes in temperature found in the ocean. For this reason, the acoustic absorption of the baffle does not change appreciably as a function of ocean water temperature changes. The present invention is therefore a baffle that will give relatively consistant absorption performance characteristics as it absorbs underwater sound from the ocean in which it is immersed.

It should also be noted that it is theoretically possible to construct a baffle of the present design that can operate at frequencies well below 800 Hz. This is because the frictional losses in the porous material (i.e. the metal strands of wire immersed in oil) are the direct result of the motion of the complaint mass. By constructing a baffle with a compliant mass that resonates below 800 Hz, it is possible to cause the porous material of strands of wire to absorb the acoustic energy. Since the present invention does not, therefore, require any mass loading for the frictional losses to occur, it is theoretically possible to construct a baffle that can be effective down to 10 Hz or less. (Of course, a baffle effective at this frequency would have to be proven through experiment, and there are few experimental facilities capable of testing baffles at this frequency). More practical baffles would be higher in their effective frequencies.

It should be noted that my other patents, U.S. Pat. Nos. 4,419,617; 4,349,615; 4,327,161; 4,179,627; and 4,126,149 all deal with energy conversion of one form or another. They do not, however, deal with the absorption of acoustic energy.

It is an object of the present invention to provide a baffle that absorbs underwater acoustic energy encountered in the ocean environment.

It is a further object of the present invention to provide an acoustic baffle that is absorptive throughout the ocean temperature range.

It is yet a further object of the present invention to provide a baffle that is effective over a wide range of frequencies.

These and other objects of the invention will become clearer when reading the detailed description of the preferred embodiment and when considering the drawings wherein.

Figure 1:
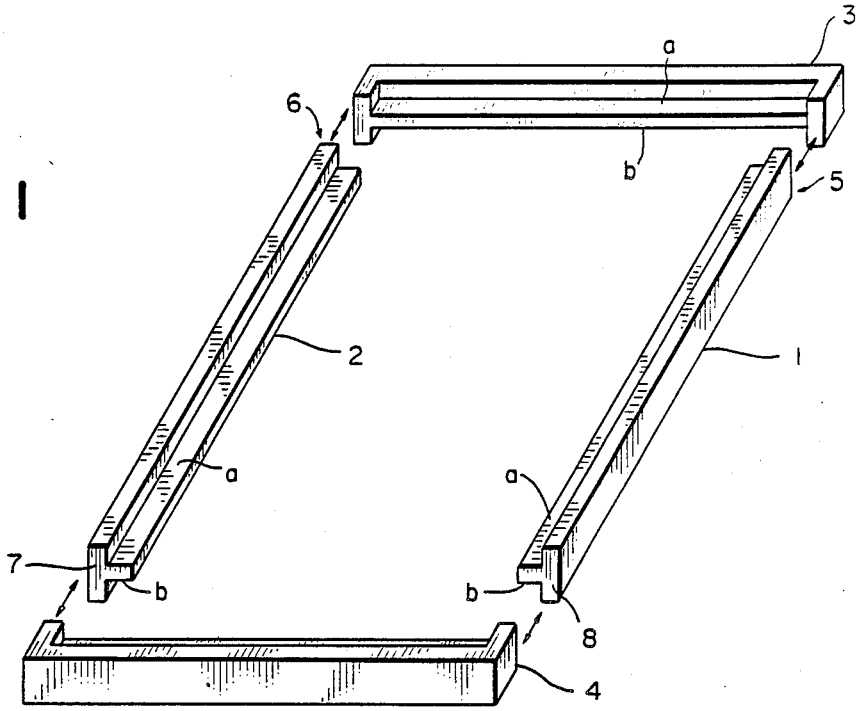
FIG. 1 is a perspective view of the component sections of metal that comprise the support for the metal beams that comprise part of a compliant mass in a preferred embodiment.

Before discussing the detailed description of the preferred embodiment, it is important to understand some of the components and their applications. One very important component part of the present invention is the compliant mass. The compliant mass can be made of many different materials. It could, for instance, comprise merely a piece of foam rubber sandwiched between two rigid plates as is taught by Denaro in U.S. Pat. No. 4,450,544. It may comprise a compliant tube or resonant tube. It is appreciated that there are many ways in which to construct a compliant mass. The present preferred compliant mass which will be shown in the preferred embodiments comprises two simply supported metal beams. The two metal beams are supported by a rectangular separator, the component parts of which are shown in FIG. 1. The separater is comprised of two metal beams 1 and 2 that are attached to metal beams 3 and 4. Beams 1, 2, 3, and 4 are attached together at junctions 5,6, 7, and 8 as shown in FIG. 1. They are welded together. The cross-sections of beams 1 and 2 each look like the letter "T" of the English alphabet. Two metal sheets or beams that make up the compliant mass are formed or cut to be positioned on surfaces a and b of FIG. 1.

Figure 2:
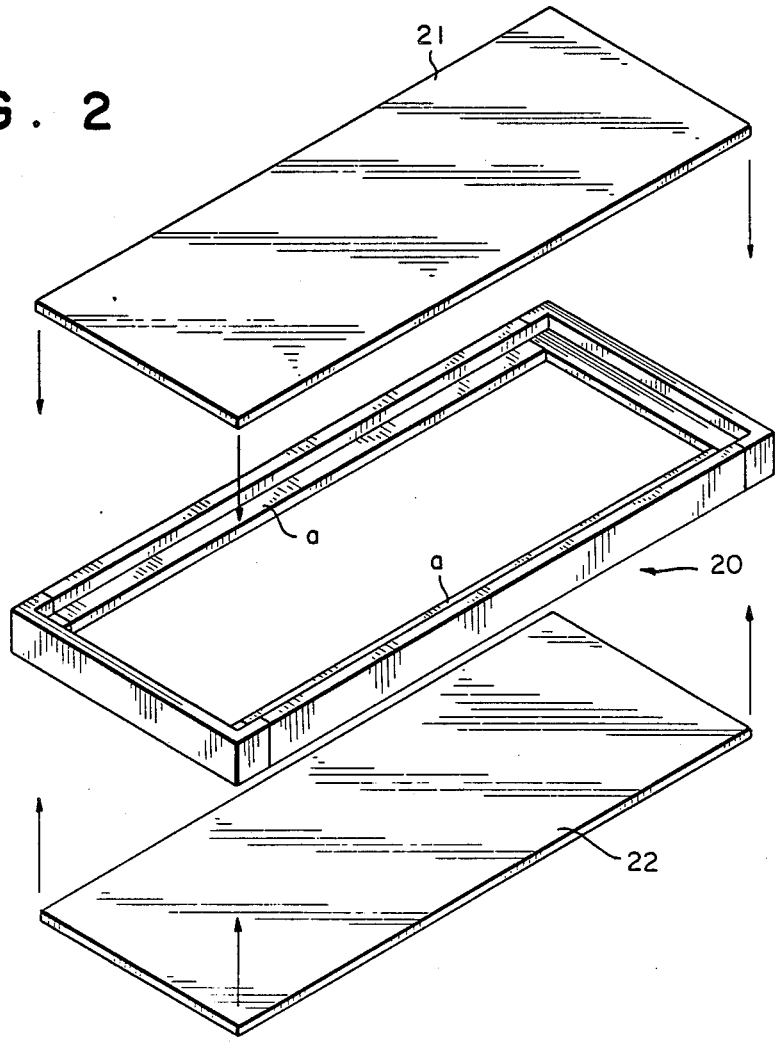
FIG. 2 is a perspective view of the simple support and the metal compliant beams that comprises the preferred compliant mass.

FIG. 2 illustrates the compliant beams 21 and 22 which are comprised of metal such as steel. The support 20, the component parts of which are shown in FIG. 1, is preferably comprised of steel, though it is appreciated that it could be composed of other metals such as copper, or aluminium. The support could even be composed of hard plastic or a compositie material. The length and width of the compliant beams 21 and 22 are such that they can be laid onto surfaces a and b (shown in FIG. 1 and FIG. 2) without being snug with respect to the support 20. The complaint beams 21 and 22 therefore fit the description of being simply supported since the edges of the compliant beams are not significantly pinned and are not clamped either.

The length, width and thickness of each of the compliant beams should be selected so that the beams will resonate at the frequency or frequencies where absorption is most desirable. Where the absorption is most desirable, of course, depends upon the intended use of the present invention. If it is important to absorb 6 db of acoustic energy at 3 kHz, then the compliant beams and support should be made so that the compliant beams can resonate at 3 kHz. This art is quite well known and can be found in many sound and vibrations texts. One reference that teaches how the dimensions of the simply supported beam affect its resonance is *Elements of Mechanical Vibration* by C. R. Freberg and E. N. Kemler (Published by John Wiley & Sons, Inc. New York., copyright 1943). Since it is so well known I will not elaborate further on the necessary dimensions, other than to give an example for the preferred embodiment. A metal beam that is 0.04 inches thick and approximately 1½ inches wide and that has a length that at least 1½ inches or longer will have a resonance of approximately 3 kHz. It is appreciated that the resonante frequency and the dimensions of the compliant beams 21 and 22 and the support 20 can be varied appreciably without departing from the spirit or scope of the preferred embodiment compliant mass.

The compliant beams and their support may be constructed to be watertight, so that it will resonate when irradiated by acoustic energy when the compliant mass is in water. It is appreciated that it will resonate in seawater, freshwater or similar fluid medium under the appropriate conditions. It is further appreciated that it will resonate in oil such as silicone oil. The fundamental criteria for making the compliant mass resonate (other than its geometry and material substance) is that it be made relatively watertight. The air gap formed in between the compliant beams 21 and 22 when the compliant mass is constructed must be maintained in order that the compliant mass resonate properly when in the ocean environment. This is also true for the oil environment as well.

The compliant mass can be made watertight by first wrapping the compliant mass in very thin plastic such as Saran Wrap or other suitable plastic wrap. The compliant mass can then be dipped in liquid silicone rubber gel and potted using standard techniques used by the rubber industry. The silicone rubber should then be allowed to dry before assembling the rest of the present invention. It is appreciated that many types of rubber encapsulent material would be suitable for making the compliant mass watertight. Amoung these include castable nitrile rubber and also RTV silicone rubber that may be found in the local drug store. Experiment verifies that the resonante frequency of the compliant mass is not seriously affected by the encapsulent rubber and also verifies that the beams approximate simply supported beams.

I have up to this point in the disclosure described in great detail how the compliant mass in the preferred embodiment may be constructed. This is because the U.S. Patent Office requires that a disclosure must be made so that those skilled in the art may know how to build the instant invention. It should be pointed out here in the disclosure that this patent application is not for the purposes of patenting the compliant mass. The only reason why I have gone into such detail concerning the compliant mass is so that an adequate understanding of the construction of the preferred embodiment can be gained by those skilled in the art who read this patent application.

Figure 3:
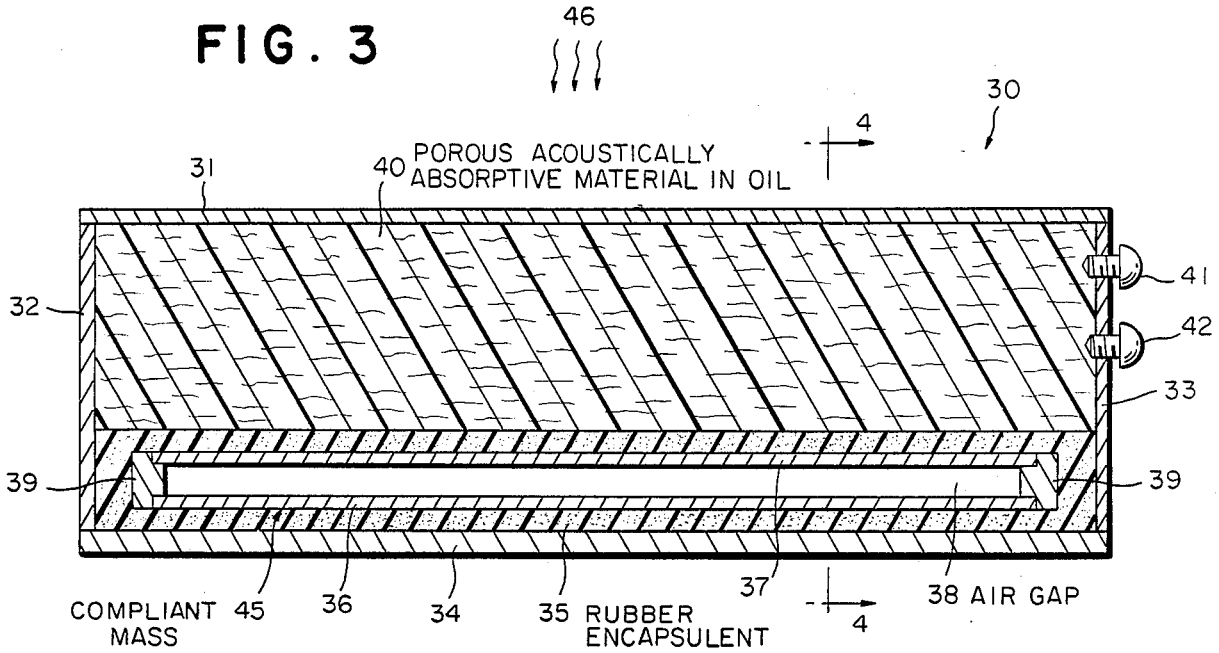
FIG. 3 is a cross-sectional view of a preferred embodiment taken along the lines of 3—3 in FIG. 4.
Figure 4:
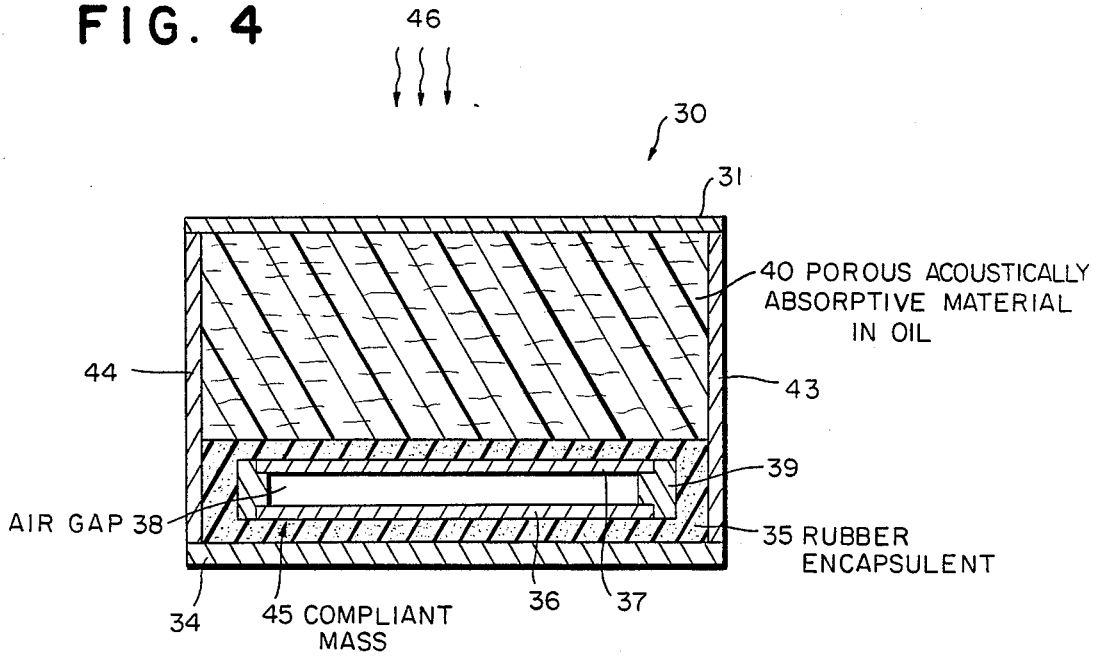
FIG. 4 is a cross-sectional view of a preferred embodiment taken along the lines of 4—4 in FIG. 3.

Referring now to FIG. 3 and 4, a preferred embodiment of the present invention 30 is shown to have housing sheets 31,32, 33, 34, 43 and 44; compliant mass 45 (which is composed of compliant mass rubber encapsulant 35; compliant beams 36 and 37 with air gap 38 therebetween as shown in FIGS. 3 and 4; and compliant beam support 39); porous acoustically absorptive material 40 in oil; and threaded end screws 41 and 42 (FIG. 3 only). The housing comprises rigid sheets 31, 32, 33, 34, 43, and 44. The housing must be watertight and preferrably rigid. (This is because the rigid housing samples have better acostic absorption characteristics than the samples that were constructed of flexible housing materials. Experiments show that this is true.) In the present preferred embodiment the housing rigid sheets 31, 32, 33, 34, 43 and 44 comprise 1/16 inch thick steel. It is appreciated that the thickness, width and lengths dimensions of the housing sheets 31, 32, 33, 34, 43, and 44 may vary from the dimensions of the preferred embodiment without departing from the scope of the invention. A 1/16 inch thick sheet of steel immersed in water will permit appreciable amounts of acoustic energy below 15 kHz to pass through it. This is well known. More information about transmission of sound through steel and other materials can be obtained in *Introduction to the Theory of Sound Transmission* by Charles B. Officer published by McGraw-Hill Book Company Inc. in New York in 1958. Yet a 1/16 inch thick sheet of steel also provides enough rigidity for the present embodiment to perform well in its acoustic energy absorption. For this reason it is chosen for the preferred embodiment. To construct the preferred embodiment, one way (it is appreciated that there are many various ways of constructing the preferred embodiment—this is just one suggested way) is to weld together housing component sheets 32, 33, 34, 43 and 44 into a box. The welding should be performed along the edges of the sheets so that the housing members will result in the embodiment as shown in FIGS. 3 and 4. The welding must be done carefully so as to ensure that the housing is of watertight intergity. Once the box is made, the compliant mass 45 is lowered into the bottom of the box. Compliant mass 45 comprises a rubber encapsulent 35; compliant beams 36 and 37 with air gap 38 therebetween; and support 39. Compliant mass 45 is constructed identically to the compliant mass referred to in FIGS. 1 and 2. Holes are then drilled and tapped into housing component sheet 33 so that screws 41 and 42 will be permitted to be screwed into said holes. Then wire strands are piled on top of compliant mass 45. The preferred wire stands are 8 mil to 12 mil in diameter and are approximately ½ to 1 inches in length. It is appreciated that the wire dimensions may differ from those of the preferred embodiment without departing from the scope or spirit of the invention. The wire strands are packed into the space allotted for absorbing material 40. The wire strands should be packed so that the wire strands occupy approximately 15% of the volume of the porous absorbing material 40 volume. It is appreciated that the amount of volume occupied by the wire strands that comprise the porous absorbing material 40 may vary without departing from the scope or spirit of the invention.

Now the housing sheet 31 is placed on the top of the box so as to fit as shown in FIGS. 3 and 4. It is then welded also its edges where it meets housing sheets 32, 33, 43 and 44. In order to ensure that the welding process does not adversely affect rubber encapsulent 35, it is advised that the welding of housing sheet 31 be done by electron beam welding processes that are well known to the welding industry. The welding must be so as to ensure that the housing of the absorbing material 40 and the compliant mass 35 is watertight.

Finally, the rest of the volume of the porous absorbing material 40 must be filled with oil that has an appropriate density so that the overall acoustic impedence of the porous absorbing material 40 volume (this means the impedence of the wire strands immersed in the oil) is approximately that of the acoustic impedence of water. This is done so that the sound can enter the present embodiment 30 and be absorbed. It is preferred that a 1000 centistoke dimethyl silicone oil be used though it is appreciated that many other types of oil may be used without departing from the scope and spirit of the invention.

Filling the remaining volume of the porous aborbing material 40 with the oil is accomplished by hooking up a hose to each of the holes through which screws 41 and 42 are eventually intended. One hose is hooked up to a reservoir of dimethyl silicone oil while the other is hook up to a vacuum source (such as an air compressor). The present embodiment 30 is then placed on its side so that housing sheet 32 faces the table upon which present embodiment 30 is placed. The oil is then permitted to enter and fill the remaining volume of porous absorbing material 40 volume. This means that in the preferred embodiment 30 has an absorbing material 40 as shown in FIGS. 3 and 4. The acoustic absorbing material material 40 comprises 15% of the volume, the rest of the volume being occupied by the oil. It is appreciated that the wire strands do not necessarily need to be steel but just as easily could comprise some other metal such as copper, iron, et. It is also appreciated that the oil used need not necessarily be dimethyl silicone oil. It could alternatively be some other kind of oil such as olive oil, caster oil, vegetable oil, etc. It is therefore appreciated that many other materials could be used without departing from the scope or spirit of the invention.

After the present embodiment 30 has been filled as much as possible with silicone oil, the hoses are detached and screws 41 and 42 are screwed into the position shown in FIG. 3. To ensure that watertight integrity is maintained, screws 41 and 42 may be treated with plumbers tape before being screwed into position. Now the present embodiment is completed and ready to be used. It may be used to absorb unwanted underwater sound. For instance, it could be used to line the sides of an acoustic tank wherein underwater sound measurements are to be taken. There are many other possible commercial uses for the present invention.

In operation, acoustic sound energy 46 passes through housing sheet 31 and into the present embodiment 30. Supposing that the absorbing material 40 is only about 1 inch in thickness (though it is appreciated that it can be made any thickness) sound that is less than 5 kHz in frequency will pass through the acoustic absorbing material 40 volume and become incident upon compliant mass 45. Compliant mass 45 resonates at its resonant frequencies. As the surface of compliant mass 45 vibrates, the wire strands of porous acoustic absorbing mateiral 40 that are proximate to said complaint mass 45 also vibrate in relative unison with the vibration of the surface of compliant mass 45 that is proximate to acoustic absorbing material 40. This is because the oil in which the wire strands are immersed has a high viscousity. Because the viscousity is so high, the wire strands proximate complaint mass 45 move with the surface of compliant mass 45. In effect, they act as though they are attached to the surface of the compliant mass 45. The high viscousity of the oil has the effect of attaching the wire strands proximate to the surface of compliant mass 45 to the surface of compliant mass 45. But the other wire strands that comprise the porous acoustically absorptive material 40 that are not in near proximity of the compliant mass 45 do not vibrate in unison with the vibration of compliant mass 45. The wire strands proximate housing sheet 31 are held relatively in place by rigid housing sheet 31. Hence, within the acoustically absorbing material 40, some of the wire strands rub against each other to create a frictional loss of the acoustic energy. It is also true that the oil in between the strands of the porous acoustically absorbing material 40 moves with respect to the wire strands. This motion of the oil through the wire strands also creates viscous losses by which acoustic energy is absorbed by the invention. But the frictional losses differ appreciably from those used by Denaro, Mason and Goodman. Denaro, Mason and Goodman who utilize a rigid plate with holes or slots in the rigid plate. The orifaces in the plate restrict the flow of oil.

In the present invention, there are no holes in the wire strands. The wire strands are relatively flexible and do not constitute a rigid plate. The wire strands rubbing against each other create frictional loss. The plates or screens used by Mason, Goodman and Denaro do not rub against themselves to cause the acoustic absorption. In the present invention the wire strands and the oil in which they are immersed constitute a propagation medium for acoustic waves of the frequencies wherein the thickness of the porous, acoustically absorbing material 40 is at least one-quarter the wavelength of the acoustic wave absorbed. The slotted plates or screens used by Mason, Goodman and Denaro do not constitute a propagation medium that carries acoustic waves but rather instead constitutes an acoustic resistance through with the wave must pass. It is therefore obvious that the physical mechanism of acoustic absorption employed by Mason, Goodman and Denaro is not the same physical mechanism that causes the acoustic absorption in the present invention.

Operation of the present embodiment 30 is understood to be in water such as is found in oceans, bays, lakes and rivers of the world. The instant invention is useful for absorbing unwanted sound in water.

Frequencies above 12 kHz for the present embodiment 30 (again, supposing that it is only 1½ inches in thickness) will begin to be attenuated as the acoustic energy enters the porous acoustic energy absorbing material 40. This is because the porous, acoustic energy absorbing material 40 in oil acts as a propagation medium for the acoustic energy. It is a lossy acoustic energy propagation medium since the thickness of the porous acoustic energy absorbing material 40 is at least a quarter wavelength of a 12 kHz sound wave in water. In thickness, it is even thicker than one-quarter the wavelength of frequencies higher than 12 kHz. Acoustic transmission line theory predicts that the thickness for an acoustic energy propagation medium must be approximately one-quarter the wavelength of the lowest frequency of sound that is intended to be absorbed in order for the absorption of that sound to be appreciable. By appreciable, it is meant at least 4 dB or more of attenuation of the sound due to absorption of that sound.

The originality of the approach to sound absorption upon which this present invention is based now becomes apparent. Acoustic transmission line theory predicts that a good acoustic energy absorbing material must have thickness dimensions on the order of approximately one-quarter the wavelength of the sound wave or more in order for appreciable absorption to take place. This means that, according to transmission line theory, for an underwater acoustic signal of 3 kHz to be appreciably absorbed by a material that has the acoustic impedence close (within about 20%) to that of water, the thickness of the acoustic absorber must be about the thickness in the relation $$\text{required thickness} = (0.25)\ c/f$$

where c is speed of sound in water and f is the frequency of the sound.

Since in water c is approximately 1500 m/sec and the frequency of the 3 kHz acoustic wave in water is 3000 cps, the required thickness is about 5 inches.

But the present invention can absorb acoustic energy at 3 kHz with at least 6 dB of acoustic attenuation due to absorption while still only being 1½ inches in thickness. It is apparent that the present invention absorbs acoustic energy in a manner not described by acoustic transmission line theory and, hence, is not an obvious phenomenon at all. That the present invention does indeed absorb acoustic underwater energy with at least 6 dB at 3 kHz will be shown in FIG. 7 which is a graph of acoustic pulse tube measurements showing the absorption of a 1½ inch thick embodiment of the present invention.

Before proceeding further to another preferred embodiment, it is useful to point out the difference between the teachings found in U.S. Pat. No. 4,528,652 and those that describe the present invention. Horner et al. employ the use of a low viscousity silicone rubber or an epoxy resin. This absorptive material has the consistancy of a flexible solid and in operation derives its acoustic absorption from hysteresis losses. It is well known that the hysteresis losses are directly related to the shear modulus and the Young's modulus and their corresponding loss factors. These are quite temperature sensitive, being described by the well known WLF transforms. It is also well known that rubber compresses under high pressure increases, thereby changing its overall density and thus its acoustic impedence. According to Bobber (see *Underwater Electroacoustics Measurements,* by Robert J. Bobber, published by the Naval Research Laboratory, July 1970, Library of Congress Catalog Card No. 72-608304, pp. 304–310) the complex impedence of an acoustic absorber that uses its shear modulus loss as the absorption mechanism is directly proportional to the hyperbolic tangent such that $$z \propto \tanh(a+ik)x$$

where a is the attenuation constant, k is the wave number, i is the square root of −1, and x is the sample thickness and Z is the complex impedence.

The hysteresis loss mechanism differs substantially from the viscous and frictional losses employed in the present invention. For the viscous drag losses, the impedence of an acoustic energy absorbing material is proportional (according to Bobber) to the hyperbolic cotangent function such that $$z \propto \coth(a+ik)\,x$$

where a, k, i, x and Z are as stated above.

It is also true that the porous, acoustic energy aborbing material 40 in oil in FIGS. 3 and 4 has no shear modulus since it is not a flexible solid material at all. The dimethyl silicone oil is not very temperature sensitive to changes in temperature found in the ocean environment because the viscousity of the oil does not change appreciably over those temperature changes. So, too is the frictional coefficient of the metal strands that rub against each other not very temperature sensitive over those temperature changes. This is a substantial improvement over the silicone rubber absorber materials as employed by Horner et al.

The present invention also differs from the invention of Horner et al. as taught in U.S. Pat. No. 4,528,652 in another respect. Horner et al. disclose a transducer that has an acoustic energy absorber material that absorbs energy from the transducer itself whereas the present invention is designed to absorb under water acoustic energy from sources in the water that are other than the present invention. To quote Horner et al.

"Since the pulsed transducer elements radiate ultrasonic energy from all surfaces, sonic energy attenuating backing material must be provided about the transducer elements to limit wave propagation from and reception by a single 'radiative' surface of the transducer." It is obvious that the intent of Horner et al. is to absorb some of the acoustic radiation from some of the transducer elements, thereby diminishing the overall acoustic energy transmitted into the water. It is also obvious that by diminishing the overall acoustic energy transmitted into the water, the return echo that is received by the transducer is subsequently diminished. Clearly, Horner et al. have disclosed nothing about absorbing acoustic energy from anything other than the transducer itself.

The intent and use of the present invention differs substantially from the invention disclosed by Horner et al. The present invention can be used to absorb background noise in water channels and tanks so that acoustic measurements taken in those sound channels and tanks will not be contaminated by said background noise.

Figure 5:
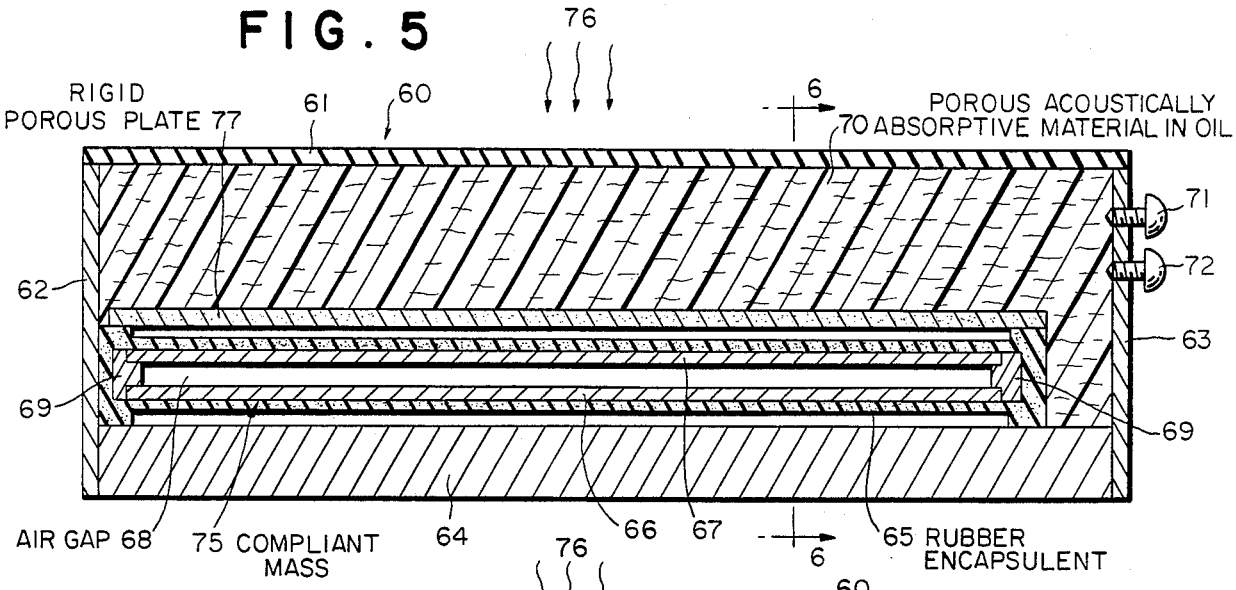
FIG. 5 is a cross-sectional view of another preferred embodiment taken along the lines 5—5 in FIG. 6.
Figure 6:
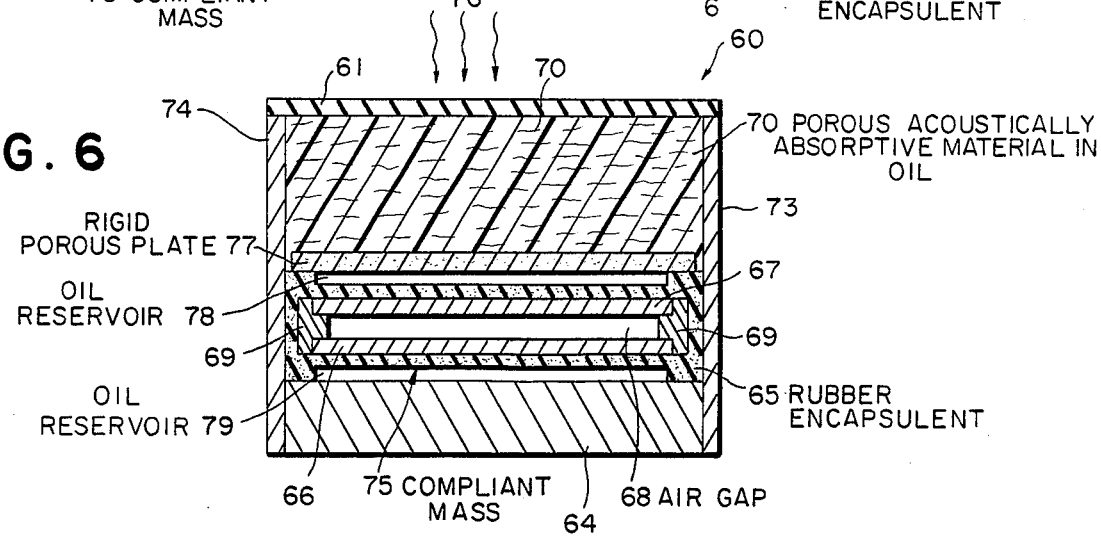
FIG. 6 is a cross-sectional view of the embodiment shown in FIG. 5 taken along the lines of 6—6 in FIG. 5.

It is appreciated that many other uses for the present invention exist. For these and other reasons, it is important to refer to FIGS. 5 and 6 wherein this preferred embodiment 60 is shown to have housing sheets 61,62,63,64,73, and 74; compliant mass 75 (which is composed of compliant mass rubber encapsulant 65; compliant beams 66 and 67 with air gap 68 therebetween as shown in FIGS. 5 and 6; and compliant beam support 69); porous acoustically absorptive material 70 in oil; rigid porous plate 77; oil reservoirs 78 and 79; and threaded end screws 71 and 72 (FIG. 5 only). The housing comprises rigid sheets 61, 62, 63, 64, 73 and 74. The housing must be watertight and preferrably rigid.

Housing sheet 61 in this embodiment comprises a porous metal foam such as aluminium-nickel impregnated with rubber. It is constructed by taking a foam of aluminium-nickel and dipping it in uncured rubber GE silicone rubber as RTV-11 and RTV-28. Housing sheet is an acoustic window. It is not, in this present embodiment an acoustically absorptive material such as the RTV silicone rubber materials as taught in U.S. Pat. No. 4,528,652. Sheet 61 is approximately 1/16 inches in thickness and is not sandwiched between a transducer and a rigid housing. It merely serves as an acoustic window for frequencies of acoustic energy (underwater) of 29 kHz and below. The silicone rubber which fills the pores of plate 61 is permitted to cure or harden. Care must be taken to ensure that sheet 61 is watertight. It is appreciated that housing sheet 61 can be constructed of various dimensions and thicknesses without departing from the scope and spirit of the invention. Housing sheets 62, 63, 64, 73 and 74 are welded into a box much the same way that housing sheets 32, 33, 34, 43 and 44 were in the earlier embodiment shown in FIGS. 3 and 4. The only difference between the housing box in embodiment 60 and the one in embodiment 30 is that housing sheet 64 in embodiment 60 is ½ of an inch in thickness instead of being 1/16 inches in thickness as was housing sheet 34 in embodiment 30. Care must be taken to ensure that the housing box comprising 62, 63, 64, 73 and 74 are watertight so that no oil may leak out of the embodiment 60 or water leak into embodiment 60 when embodiment 60 is completely box. Compliant mass 75 should be spaced from housing sheet 63 as shown in FIG. 5 in order that reservoirs 78 and 79 can be easily filled with oil later. Rubber encapsulant 65 is fashioned so that its ends that are proximate housing sheets 73 and 74 are thicker than anywhere else. The encapsulant 65 thus serves as a means for spacing compliant beams 66 and 67 and spearater 69 from housing sheet 64 and rigid, porous plate 77 as shown in FIG. 6. Next rigid porous plate 77 is placed onto compliant mass 75 as shown in FIG. 77. Rigid, porous plate 77 is constructed in such a way as to not fit snuggly into the housing box but instead has some clearance space between it and the housing as shown in FIG. 6. The reason for this will become apparent later on in the disclosure. Holes are drilled and tapped in housing sheet 63 so that screws 71 and 72 may be screwed into said holes. Wire strands are then piled into the remaining volume in the interior of the housing box. The preferred wire strands are 8 mil to 12 mil in diameter, are steel and are approximately ½ to 1 inches in length. It is appreciated that the wire dimensions may differ from those of the preferred embodiment without departing from the scope or spirit of the invention. The wire strands are packed so that they occupy 15% of the volume (approximately) of the porous, acoustic energy absorbing material 70 volume, as it is shown in FIG. 6. It is appreciated that the amount of volume occupied by the wire strands may vary from the preferred 15% without departing from the scope and spirit of the invention.

Now housing sheet 61 is placed on top of the box and is bonded using more RTV-11 or RTV-28 as the bonding agent. Care must be taken to ensure that the bond is watertight.

Finally, the remaining unfilled volume of the housing of embodiment 70 is filled with oil and then screws 71 and 72 are screwed into position as shown in FIG. 5. It is preferred that 1000 centistoke dimethyl silicone oil be used in the present embodiment 60. It is appreciated that other types of oil could be used instead of 1000 centistoke silicone oil without departing from the scope and spirit of the invention. Once the embodiment 60 is constructed, it may be used to absorb unwanted sound in water. For example, it could be used to line the sides of an acoustic tank wherein underwater sound measurements are to be taken. There many other possible uses for the present invention.

In operation, acoustic sound energy 76 passes through housing sheet 61 and into embodiment 60. The sound propagates through porous, acoustic energy absorbing material 70.

Some of this acoustic energy (the high frequencies where the thickness of the porous, acoustic energy absorbing material 70 is at least one-quarter the wavelength of the acoustic energy) is partially absorbed by the porous, acoustic energy absorbing material 70 while the rest (the low frequencies where the wavelength of the acoustic energy is much greater than 4 times the thickness of the porous, acoustic energy absorbing material 70 and also the higher frequency sound that did not yet become absorbed by acoustic energy absorbing material 70) impinges upon rigid, porous plate 77 and the compliant mass 75. Some of the acoustic energy excites the rigid, porous plate 77 and the rubber upon which it rests into resonance, since the rigid, porous plate 77 and the underlying rubber acts as a mass-spring system. Some of the acoustic energy excites the compliant beams 66 and 67 into resonance which in turn causes motion of the oil in reservoirs 78 and 79. The rigid, porous plate 77 therefore moves with respect to the oil and the oil in the reservoirs moves with respect to the rigid porous plate 77. Viscous losses of the kind employed by Mason, Goodman and Denaro and taught in U.S. Pat. No. 4,450,544 are indeed experienced. There is, however, an improvement in this embodiment. Denaro et al. rigidly fix the slotted plates to the housing. The plates remain rigid as long as the housing and the mass to which the housing is attached are enough to hold the position of the plate fixed and not allow the plates to move with the oil. But at low frequencies, below 700 Hz, the mass required to keep the slotted plate rigid and fixed becomes larger than the mass of most ships, anechoic tanks, etc. It is therefore frequency limited at the low frequency end. The present embodiment allows the rigid, porous plate 77 to MOVE AGAINST the flow of oil. The porous plate 77 does not need to be fixed to the housing and does not need to be mass loaded. Because it can move against the motion of the oil, viscous losses are increased over those that would occur if the plate were merely fixed to the housing. Furthermore, the motion of plate 77 causes frictional losses to occur in the porous, acoustic energy absorbing material 70. This occurs as a result of the motion of the wire strands in acoustic material 70 rubbing against each other and causing frictional losses. The wire strands proximate porous plate 77 move in relative unison with the motion of porous rigid plate 77 owing to the fact that the viscousity of the oil is so high. The wire strands proximate housing plate 61 do not move with the motion of rigid, porous plate 77 since these wire strands are prevented from doing so by housing plate 61. In this manner, acoustic losses occur in the same manner as in embodiment 30. Thus the present invention is not limited at the low frequency end.

Figure 7:
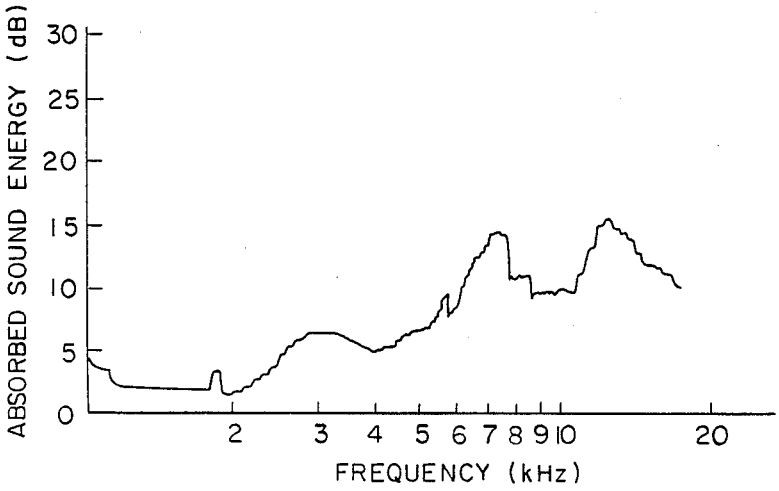
FIG. 7 is a graph showing the amount of sound energy absorbed by the invention that is depicted in FIGS. 3 and 4.

A 1½ inch thick waveguide sample was constructed and tested to determine the amount of energy absorbed by embodiment 30, shown in FIGS. 3 and 4. The test results are shown in FIG. 7. As shown in FIG. 7, 6 dB of acoustic energy was absorbed by the sample at a frequency of 3 kHz. More energy was absorbed at higher frequencies. Experiment has shown that the invention can provide significant acoustic energy absorption as an acoustic energy absorbing baffle.

As stated previously, in operation, sound energy 46 in FIGS. 3 and 4 passes through housing sheet 31 and into embodiment 30. This is possible since housing sheet 31 is so thin that it acts as acoustic window. This occurs when the wavelength of the incident sound energy 46 is greater than 8 times the thickness of housing sheet 31. This is in accordance with well known theory and can be found in many acoustic texts including a text cited earlier named *Introduction to the Theory of Sound Transmission* by Charles B. Officer. In the embodiment 30, therefore, housing sheet 31 is an acoustic window for acoustic energy frequencies that are waterborne and are less than 35 kHz. It is appreciated that the housing can therefore act as the acoustic window for appropriate frequencies of acoustic energy. It is further appreciated that portions of the housing can be made from other acoustic window materials other than the steel sheet that has been disclosed here for embodiment 30.

As stated previously, the present invention utilizes a dissipation means comprising wire strands immersed in oil. It is not obvious that these wire strands can dissipate appreciable amounts of acoustic energy that has wavelengths greater than four times the thickness of the wire strands and oil. However, when the wire strands immersed in oil are positioned adjacent to a compliant mass, as shown by the experimental results in FIG. 7, the wire strands in oil can dissipate appreciable amounts of this kind of acoustic energy. Furthermore, the dissipation mechanism of metal strands in oil differs substantially from the acoustic dissipation means disclosed by Horner et al in U.S. Pat. No. 4,528,652. Many differences between the dissipation mechanism of the present invention and the art disclosed by Mason and Denaro have already been discussed.

In this disclosure and also in the claims to follow, the word STRAND will be used with the following definition intended:

strand: "... Any single fiber, thread or other filament ..."*

**The American Heritage Dictionary of the English Language, New College Edition*, William Morris, Editor, Published by Houghton Mifflin Company, Boston, Copyright 1969, 1970, 1971, 1973, 1975 and 1976.

It is appreciated that one may use compliant metal tubes as a compliant mass in the present invention. It is further appreciated that many other embodiments of the invention have been omitted from this disclosure since a complete disclosure would require an infinite number of embodiments to be disclosed. It is therefore appreciated that other acoustic energy absorbing baffles may be constructed without departing from the scope or spirit of the invention.

It is further appreciated that one may use a plurality of compliant masses within a fluid containment housing and achieve significant sound absorption. For instance, instead of using one compliant mass, one may use a plurality of them to replace the compliant mass 45 of embodiment 30 shown in FIGS. 3 and 4. It is appreciated that a plurality of compliant beams may be used in a compliant mass in the present invention. For example, a compliant mass comprising two metal beams with their support may be constructed as shown in FIG. 2. Then a second compliant mass comprising two metal beams with their support may be constructed as shown in FIG. 2.

These two compliant masses may be placed side by side and then wrapped in plastic and encapsulated in rubber. Thus, a single compliant mass may be constructed from the two compliant masses. However, this new single compliant mass now has four compliant metal beams within the rubber encapsulent. Thus, a plurality of metal beams may be used as part of the overall compliant mass that is housed in the fluid containment housing of embodiment 30 instead of just two metal beams being used as is shown in FIGS. 3 and 4.

It is appreciated that plurality of compliant masses (one single compliant mass without encapsulent is shown in FIG. 2) may be placed side by side and encapsulated in rubber to comprise a single compliant mass with a plurality of metal beams that are simply supported.

I claim as my invention:

1. A baffle for absorbing underwater acoustic energy comprising:

(a) a fluid container having a rigid acoustic window and rigid walls, (b) a porous material comprising a plurality of individual, unconnected strands immersed within and throughout substantially the entire viscous fluid, said porous material contained within said fluid container, and (c) a compliant resonating mass positioned proximate said porous material for imparting vibrational energy to said strands by causing frictional losses from movement of individual strands in a region proximate said compliant, resonating mass against relative non-movement of individual strands in a region proximate said rigid window and rigid walls of said container.

2. A baffle as defined in claim 1 wherein said fluid container comprises metal.

3. A baffle as defined in claim 1 wherein said strands comprise metal wires.

4. A baffle as defined in claim 3 wherein said strands comprise metal wire of size ranging from 8 mil to 12 mil.

5. A baffle as defined in claim 1 wherein the resonating mass comprises a plurality of metal beams positioned proximate each other and encapsulated in rubber.

6. A baffle as defined in claim 1 wherein said viscous fluid comprises silicone oil.

7. A baffle as defined in claim 1 wherein said plurality of individual metal strands comprise steel.

8. A baffle as defined in claim 6 wherein said silicone oil has viscousity of approximately 1000 centistokes.

9. A baffle as defined in claim 1 wherein said compliant, resonating mass is positioned in contact with said porous material.

10. A baffle as defined in claim 9 wherein said compliant, resonating mass includes a compliant material.

11. A baffle as defined in claim 10 wherein said compliant material includes a pair of plates arranged parallel to one another with a gap therebetween.

12. A baffle as defined in claim 11 wherein air is contained within said gap.

13. A baffle as defined in claim 1 wherein said compliant, resonating mass includes a compliant mass made of a pair of plates arranged parallel to one another and a rigid porous plate positioned proximate said pair of plates and placed between said window and said pair of plates so as to be in contact with said porous material.

14. A baffle as defined in claim 13 wherein said pair of plates is encapsulated in rubber.

15. A baffle as defined in claim 14 wherein said rigid porous plate is positioned in contact with said rubber.

16. A baffle for absorbing underwater acoustic energy comprising:

(a) a fluid container having a rigid acoustic window and rigid walls, (b) a viscous fluid contained within said fluid container, (c) a resonating mass, and (d) means for dissipating acoustic energy comprising a plurality of individual, unconnected strands positioned proximate said resonating mass and immersed within and throughout substantially the entire viscous fluid for causing frictional losses from movement of said individual, unconnected strands in a region proximate said resonating mass against relative non-movement of individual strands in a region proximate said rigid window and rigid walls of said container.

17. A baffle as defined in claim 16 wherein said resonating mass comprises a plurality of metal beams positioned proximate each other and encapsulated in rubber.

18. A baffle as defined in claim 16 wherein said plurality of individual strands comprise metal wire.

19. A baffle as defined in claim 16 wherein said viscous fluid comprises silicone oil.

20. A baffle as defined in claim 19 wherein said silicone oil has viscousity of approximately 1000 centistokes.

21. A baffle as defined in claim 16 wherein said wire strands comprises wire of size 8 mil to 12 mil.

22. A baffle as defined in claim 16 wherein said plurality of individual wire strands comprise steel.

23. A baffle as defined in claim 16 wherein said resonating mass is positioned in contact with said porous material.

24. A baffle as defined in claim 23 wherein said resonating mass includes a compliant material.

25. A baffle as defined in claim 24 wherein said compliant material includes a pair of plates arranged parallel to one another with a gap therebetween.

26. A baffle as defined in claim 25 wherein air is contained within said gap.

27. A baffle as defined in claim 16 wherein said resonating mass includes a compliant mass made of a pair of plates arranged parallel to one another and a rigid porous plate positioned proximate said pair of plates and placed between said window and said pair of plates so as to be in contact with said porous material.

28. A baffle as defined in claim 27 wherein said pair of plates is encapsulated in rubber.

29. A baffle as defined in claim 28 wherein said rigid porous plate is positioned in contact with said rubber.

30. A baffle for absorbing underwater acoustic energy comprising:

(a) a fluid containment means for containing a fluid and having a rigid acoustic window and rigid walls, (b) a viscous fluid contained within said fluid containment means, (c) a compliant, resonating mass positioned within said containment means and comprising two metal beams spaced proximate each other and encapsulated in rubber, (d) a rigid, porous material positioned within said containment means and spaced proximate said compliant, resonating mass, (e) a plurality of individual, unconnected wire strands immersed within and throughout substantially the entire viscous fluid and positioned proximate said rigid, porous material for causing frictional energy losses from movement of said individual, unconnected strands in a region proximate said compliant, resonating mass against relative non-movement of individual, unconnected strands in a region proximate said rigid window and rigid walls of said fluid containment means.

31. A baffle as defined in claim 30 wherein said viscous fluid comprises silicone oil.

32. A baffle as defined in claim 30 wherein said fluid containment means comprises metal.

33. A baffle as defined in claim 30 wherein said plurality of individual wire strands comprise metal.

34. A baffle as defined in claim 33 wherein said metal is steel.

35. A baffle as defined in claim 31 wherein said silicone oil has viscousity of approximately 1000 centistokes.

36. A method of absorbing sonic energy comprising the steps of:

(a) providing a housing having a rigid window and rigid walls, (b) positioning a resonating mass within said housing and spaced from said window, (c) placing a porous material including individual strands of material immersed within a viscous fluid in a region between and in contact with said window, walls and resonating mass, (d) absorbing a portion of said sonic energy by resonating said resonating mass at a frequency of said sonic energy, (e) absorbing another portion of said sonic energy by frictional losses from movement of said individual strands in a region proximate said resonating mass against relative non-movement of individual strands in a region proximate said rigid window and rigid walls of said housing.

* * * * *